United States Patent [19]

Fischer

[11] Patent Number: 4,898,309

[45] Date of Patent: Feb. 6, 1990

[54] APPARATUS USED TO FACILITATE THE DONNING OF ELASTIC GLOVES

[75] Inventor: Dan E. Fischer, Sandy, Utah

[73] Assignee: Ultradent Products, Inc., Salt Lake City, Utah

[21] Appl. No.: 149,352

[22] Filed: Jan. 28, 1988

[51] Int. Cl.[4] ..... A47G 25/90

[52] U.S. Cl. ..... 223/111; 2/168; 206/438; 248/314; D2/641

[58] Field of Search ..... 223/111, 112; 2/161, 2/16, 168, 160, 303, 335, 162; D28/54.1; 312/1; 206/278, 438, 439, 440, 210; 248/314, 289; D2/641

[56] References Cited

U.S. PATENT DOCUMENTS

| | | | |
|---|---|---|---|
| D. 275,239 | 8/1984 | Raso | D2/641 |
| 1,938,685 | 12/1933 | Breuls . | |
| 1,996,377 | 4/1935 | Hinchen . | |
| 2,106,348 | 1/1938 | Hall . | |
| 2,741,410 | 4/1956 | LaViolette . | |
| 2,853,591 | 9/1958 | Fine | 28/54.1 |
| 2,982,453 | 5/1961 | Zicarelli | 223/112 |
| 3,086,674 | 4/1963 | Scheuerman | 312/1 X |
| 3,237,821 | 3/1988 | Hayne . | |
| 3,555,564 | 1/1971 | Miskell . | |
| 3,695,493 | 10/1972 | Karr . | |
| 4,069,913 | 1/1978 | Harrigan | 223/111 X |
| 4,228,935 | 10/1980 | Madray | 223/111 |
| 4,238,061 | 12/1980 | Marchetti et al. | 223/111 |
| 4,637,532 | 1/1987 | Doorenbos | 223/112 X |

FOREIGN PATENT DOCUMENTS

| | | | |
|---|---|---|---|
| 362814 | 8/1962 | Switzerland | 248/314 |

*Primary Examiner*—Andrew M. Falik

*Attorney, Agent, or Firm*—H. Ross Workman; Rick D. Nydegger; Allen R. Jensen

[57] ABSTRACT

A system for facilitating the donning of gloves having elastic cuffs. The system is particularly adapted for allowing healthcare personnel to don elastic gloves without requiring the assistance of another individual and without contacting the outer surface of the gloves. A curved rim member is comprised of flared portions along the periphery of the rim as well as teeth which are formed on the upper edges of a slot, the flared portions and teeth serving to help the rim frictionally to hold the elastic cuff of a glove in a stretched open configuration so that the user's hand may be inserted therein. A slot in combination with the design of the curved rim member and the flared portion and teeth of the rim member allows the user, by proper movement of the wrist and forearm, to release the glove from the curved rim member whereupon the glove assumes a proper fit on the user's hand.

41 Claims, 6 Drawing Sheets

APPARATUS USED TO FACILITATE THE DONNING OF ELASTIC GLOVES

BACKGROUND

1. The Field of the Invention.

This invention relates to a device used in connection with the donning of gloves. More particularly, the present invention relates to an apparatus used to facilitate the donning of elastic gloves such as those used by health care professionals.

2. The Prior State of the Art.

Elastic gloves have become indispensable in the practice of modern health care procedures. Medical personnel such as surgeons, nurses, paramedics and dentists working in emergency rooms, intensive care units, obstetrics, dental offices, and many other similar environments are all routinely required to use such gloves, particularly if there is any risk of contact with body fluids. Typically, the gloves are fabricated from latex and assume a "skin tight" fit when applied to the hand, and are disposed of after a single use. Such elastic gloves are also used by industry in applications such as clean room environments or food handling and processing where protection of workers and/or products from contamination is necessary.

In light of growing concern over the spreading epidemic of acquired immune deficiency syndrome (AIDS), it is more important than ever before for health care professionals to stop the spread of disease from an infected patient to the attending professional. This is in addition to the long recognized need to prevent transfer of infectious organisms from the hands of the attendant to the patient. Thus, health care professionals have adopted the practice of donning, removing, and donning new gloves much more often than previously thought necessary in order to protect themselves from infection as well as to protect their other patients from cross-contamination.

For example, dentists often employ several assistants who will each be simultaneously preparing a patient for the dentist's attention. Disadvantageously, as the dentist circulates among the patients the dentist must take the time to change gloves each time a different patient is examined. Due to the tight fit and elastic nature of the gloves, donning a pair of gloves may be time consuming and tedious. This is particularly so when the gloves must be donned without assistance.

An operating room is another environment of special concern where gloves must be worn. As opposed to the dentist's office where the outside surface of the gloves must be merely clean, the outside surface of the gloves used in the operating room must be sterile. Even in the operating room a change of gloves is often required due to the fact that gloves may be punctured or contaminated in some way during a procedure.

In order to keep the outside surface of prepackaged gloves sterile, conventional operating room procedure requires that an individual such as a scrub nurse first don a pair of gloves while making certain that the outside surface of the gloves does not come in contact with any unsterile object. The scrub nurse then assists the other members of the surgical team with the donning of their gloves.

Thus, many health care professionals are finding that they must don new gloves regularly throughout the workday. Nevertheless, many professionals dislike this necessity since putting on a pair of elastic gloves can be time consuming, especially without another individual to assist. These same mentioned considerations also apply in the industrial and scientific environments where gloves are similarly used.

In view of the foregoing, it would be an advance in the art to provide a glove applicator system which would allow a person to easily don a pair of elastic gloves without requiring the assistance of another individual. It would be a further advance in the art to provide a glove applicator system which would maintain the sterility or cleanliness of the outer surface of the gloves putting them on. It would also be an advance in the art to provide a glove applicator system which may be used with many different sizes and styles of elastic gloves without modification.

OBJECTS AND BRIEF SUMMARY OF THE INVENTION

In view of the present state of the art, it is a primary object of the present invention to provide an apparatus which facilitates the donning of elastic gloves by an individual.

It is another object of the present invention to provide an apparatus by which a sterile glove may be installed onto a hand while maintaining the sterility of the outer surface of the glove.

It is a further object of the present invention to provide an apparatus which allows an individual to easily don a pair of elastic gloves without requiring the assistance of another individual.

It is another object of the present invention to provide a glove applicator system which allows different styles and sizes of gloves with elastic cuffs to be used.

It is yet another object of the present invention to provide a glove applicator system which is simple, inexpensive, versatile, and is strongly constructed so as to withstand the rigors of frequent daily use.

It is still another object of the present invention to provide a glove applicator system which may be conveniently disinfected or sterilized and used in a clean or sterile environment.

It is yet another object of the present invention to provide a glove applicator system which allows the user to don a right and left glove simultaneously, and very quickly.

Additional objects and advantages will be apparent from the description which follows, or may be learned by the practice of the invention.

Consistent with the foregoing objects, the present invention provides a glove applicator system which makes donning a glove having an elastic cuff, or a glove in which the complete glove is fabricated from an elastic material, much easier and quicker, as well as allowing the outer surface of the glove to remain untouched during its application. As used herein, "elastic" means any material which can be stretched and which is at least in part resilient, tending to return to its original shape once released.

The present invention comprises a glove holding means which engages the elastic cuff of a glove. A user installs the glove on the apparatus by stretching the glove over the glove holding means. The glove holding means holds the glove open and maintains the glove cuff in an open configuration so that the thumb and finger portions of the inside of the glove are presented to the user. With the glove cuff held in the open configuration, the hand may be easily inserted into the glove.

In the described embodiments, the glove holding means comprises a curved rim and other structures to frictionally engage the outer surface of the glove cuff as the cuff is stretched over and installed on the curved rim. Also provided as part of the apparatus is a release means for releasing the glove. In one presently preferred embodiment the release means comprises a slot provided in an elongated, cylindrical member which allows the hand, wrist and forearm to move outward from the interior of the cylindrical member in order to release the glove cuff from the glove holding means once the hand is inserted into the glove. Thus, in order to don the glove the user need not touch any structure or the outer surface of the glove after the glove is installed on the apparatus.

A support means is also provided to attach the apparatus to a stationary object such as a wall or to a stand adapted for such use. The movement of the apparatus must be limited, or is preferably stationary, while the glove is installed on the apparatus and while the hand is inserted into the glove.

BRIEF DESCRIPTION OF THE DRAWINGS

In order to more fully understand the manner in which the above-recited advantages and objects of the invention are obtained, a more particular description of the invention will be rendered by reference to specific embodiments which are illustrated in the accompanying drawings. Understanding that these drawings depict only typical embodiments of the invention and are therefore not to be considered limiting of its scope, the presently understood best mode and presently preferred embodiments of the invention will be described in detail through the use of the accompanying drawings, in which.

DETAILED DESCRIPTION OF THE PREFERRED EMBODIMENTS

Figure 1:
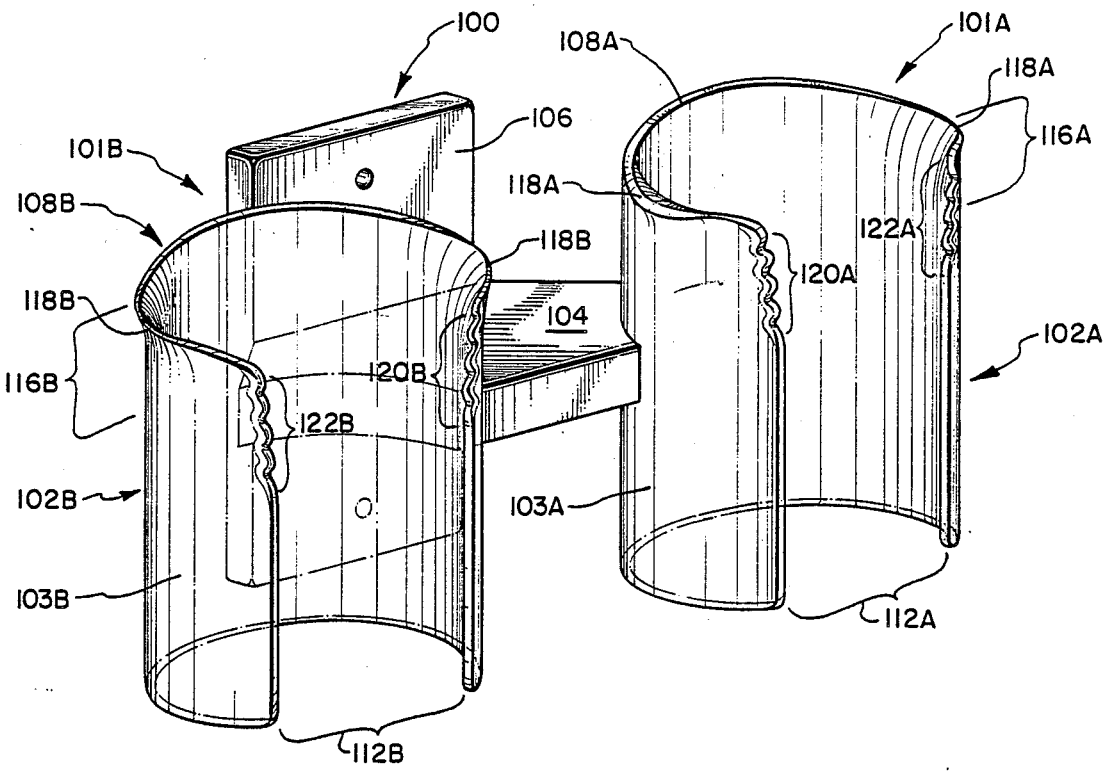
FIG. 1 is a perspective view of a first presently preferred embodiment of the present invention.

Reference will now be made to the drawings wherein like structures are provided with like reference numerals.

In this description of the preferred embodiments terms such as "top and bottom," "upper and lower," and "front and rear" will be used for ease of reference to the illustrated structures. However, such adjectives are used in reference to the orientation of the figures and in actual practice the structures of the embodiments may assume a different orientation.

Furthermore, the illustrated embodiments will be described using what are commonly referred to in the health care field as "latex examination gloves." Such gloves, as well as latex surgical gloves, are inherently elastic so as to take on a skin-tight fit when donned. Nevertheless, the present invention has application with other types of elastic gloves or gloves having only an elastic cuff.

In FIG. 1 a first embodiment of the glove applicator system is generally designated at 100. The entire apparatus is preferably fabricated from any suitable plastic material by conventional molding techniques well known in the art. Alternatively, where sterilization of the apparatus may be desirable, the apparatus or parts thereof may be fabricated from metal such as stainless steel or from a high heat plastic which will permit sterilization.

Since it is nearly always preferable to simultaneously don a pair of gloves rather than only one glove at a time, two glove applicators, generally designated at 101A and 101B, are provided. Use of two applicators for right and left hands permits simultaneous, quick installation of the gloves in accordance with one of the objects of the invention.

Glove applicators 101A and 101B are preferably provided with similar structural features. However, since glove applicator 101A is used to glove the right hand and glove applicator 101B is used to glove the left hand, it is preferable to form each glove applicator as the "mirror image" of the other as shown in FIG. 1. Thus, in the following description, when referring in detail to one glove applicator of a pair, it should be understood that the other glove applicator in that pair will have corresponding structure.

As mentioned above, the apparatus of the present invention comprises a means for receiving and holding the cuff of an elastic glove in a stationary, open configuration such that the glove is ready to receive a hand as it is inserted into the glove, and also a release means for releasing the glove onto the hand after the hand is inserted therein and as the hand is then pulled down through the glove so as to completely install the glove onto the hand, and if desired, also the wrist and forearm of the user.

In the embodiment of FIG. 1, as hereinafter more fully described, the means for receiving and holding the cuff of the glove in the stationary, open configuration comprises a generally cylindrical member 102 which terminates in an upper rim 108. Cylindrical member 102 may have elongated sidewalls 103 such as illustrated in FIG. 1, or alternatively, as illustrated in later embodiments to be hereafter described, cylindrical member 102 may be foreshortened to include only the upper rim 108 and subrim portion 116. Cylindrical member 102 may also be provided with a slot 112 to accomodate removal of the user's hands once the hands have been inserted into the gloves, or as described in other embodiments hereinafter, cylindrical member 102 may comprise a solid structure around its entire periphery.

Figure 4:
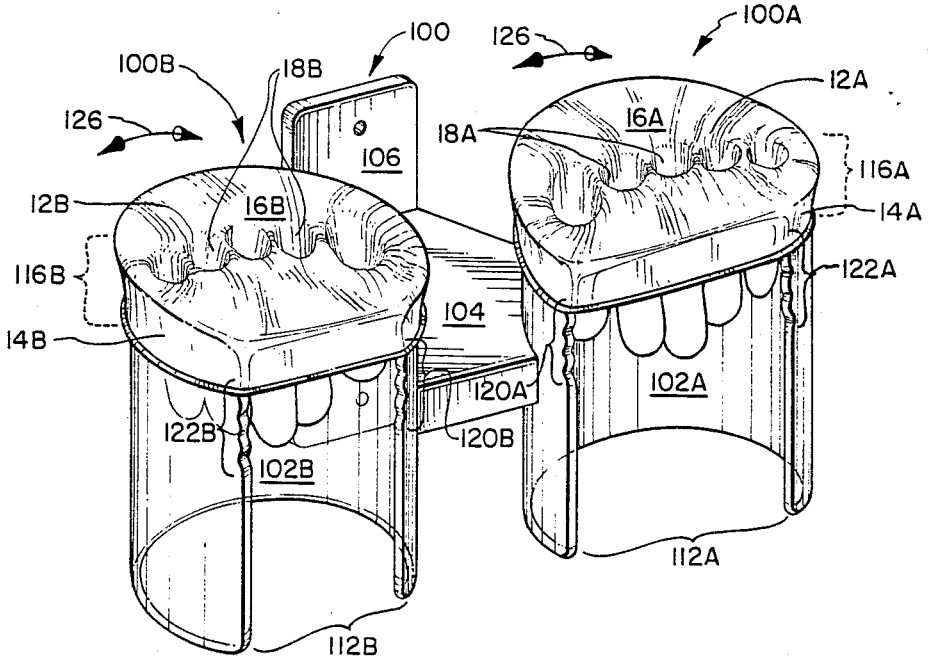
FIG. 4 is a perspective view of the first embodiment showing a pair of gloves installed on the apparatus and ready for insertion of the hands into the gloves.
Figure 5:
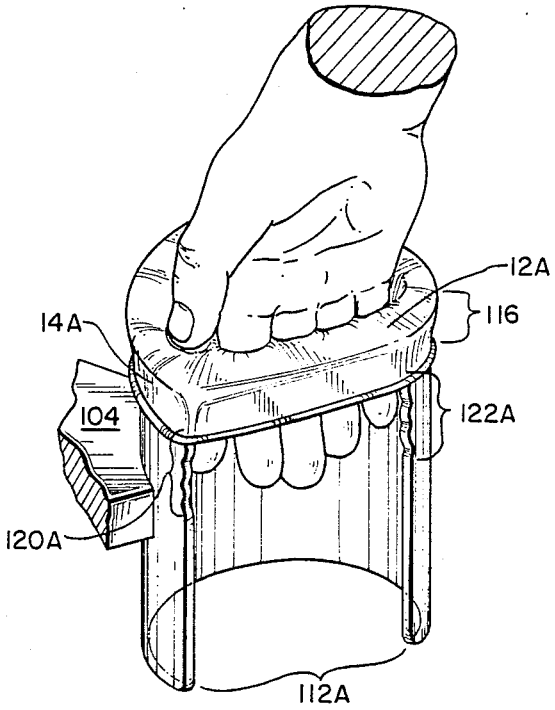
FIG. 5 is a perspective view of a portion of the embodiment shown in FIG. 4 with a hand being inserted into the glove.

As illustrated best in FIG. 4 and as hereinafter more fully described, cylindrical member 102 is adapted to receive over the upper rim 108 thereof the elastic cuff 14 of a glove 12. The cuff 14 of the glove 12 is stretched over the rim so as to expose the inside surface 16 of the glove.

As explained earlier, one object of the present invention is to allow an individual to don a pair of gloves without contaminating the outer surface of the gloves. In order to accomplish this objective, glove 12 may be installed onto the apparatus by inserting the thumbs of both hands into the glove cuff and stretching the cuff over the curved rim 108 of the applicator 101. Preferably, the elastic cuff 14 of glove 12 is pulled down far enough over rim 108 and cylindrical member 102 so that the thumb and finger holes 18 are easily visible and are presented near the upper rim 108 of cylindrical member 102.

With reference again to FIG. 1, the cylindrical members 102 are each mounted to a support means for maintaining cylindrical members 102 stationary as the gloves are placed onto the cylindrical members and as the gloves receive the hands and also while the gloves are removed after they are installed onto the hands. In the illustrated embodiment, the support means comprises a bracket 104 which in turn is attached to a plate 106 which can be vertically mounted on a wall or other rigid structure for purposes of firmly holding the cylindrical members 102 as the gloves are placed thereon and as the hands are inserted into the gloves. Cylindrical members 102 are mounted to bracket 104 so that the cylindrical members 102 are held a comfortable distance apart from one another. Cylindrical members 102 preferably are not mounted too close together because otherwise the user cannot comfortably place his hands into the gloves with a simple downward vertical motion. Thus, spacing between the cylindrical members 102 should be such that the user can place his hands into the gloves with essentially a straight downward movement. Additionally, the plate 106 should be mounted at a heighth so that the cylindrical members are slightly above waist level to the user so that the gloves can be installed on the hands without having to move the hands further down than the point at which they would normally hang at the sides of a person.

Elongated sidewalls 103 of cylindrical members 102 are integral with rim 108 and subrim 116. Extending sidewalls 103 and having the cylindrical member 102 nearly encompassing the glove (as shown in FIG. 4) protects to some degree the outer surface of the glove from contamination arising from contact with the user's body, clothing, or from other possible contaminating environment.

Figure 3:
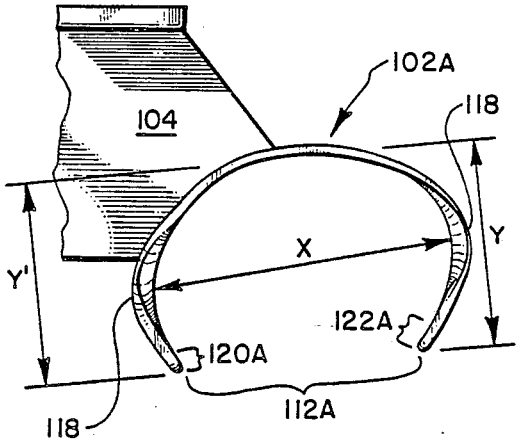
FIG. 3 is a top view showing a portion of the first embodiment.

In the top view of FIG. 3 the curved perimeter of rim 108 can best be seen. The general shape of rim 108 may be described as an incomplete modified ellipse. While not essential for operation of the apparatus in accordance with the broad principles of the invention as described herein, in the presently preferred embodiments of the invention the ellipsoidal shape of the cylindrical member 102 is designed so that the elastic cuff 14 will be stretched in the dimension as illustrated at "X" in FIG. 3 to a greater degree than in the dimension "Y." In the X dimension the latex glove is stretched so that the thumb and finger openings 18 (see FIG. 4) are generally aligned across the X dimension. On the other hand, in the Y dimension the elastic cuff 14 is stretched a minimal distance. This is because in the Y dimension the thickness of a hand is less than the width of the hand across the X dimension. Also, note that the dimension Y' as shown in FIG. 3 is slightly wider than the dimension Y because the hand is slightly thicker where the thumb joins the hand, thereby preferably requiring slightly more room.

Thus, in summary, as will be readily appreciated from FIG. 3, the modified ellipsoidal shape of the cylindrical member 102 is advantageously selected so as to generally conform to the size and shape of the hand and so as to provide a convenient guide for insertion of the hand into the glove.

The dimensions of rim 108 may vary according to the size of glove. The dimensions of rim 108 must be large enough, at a minimum, to allow a hand to pass through the rim. At a maximum, the dimensions of rim 108 must allow the glove cuff to be easily stretched over rim 108 without tearing. Within these two extremes, there is a broad range of dimensions which will be suitable. Generally, the interior dimensions of rim 102 may be chosen so that a range of sizes of gloves (e.g., small, medium, large, and extra large) may be conveniently used with the apparatus 100, enhancing its versatility.

Figure 2:
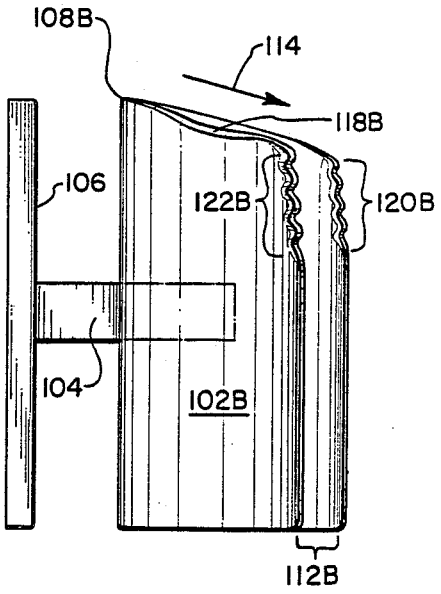
FIG. 2 is an elevated side view of the first embodiment.

With continued reference to FIGS. 1–3, in addition to the upper rim 108 of cylindrical member 102, the holding means for receiving and holding cuff 14 of glove 12 in a stationary, open configuration is also comprised of further additional structure specifically designed to frictionally and/or mechanically hold the cuff 14 as it is stretched into place over the rim 108. This additional structure of the holding means comprises, in the illustrated embodiment, ear means which are formed by flared portions 118 along the periphery of rim 108 as well as teeth which are formed as shown at brackets 120, 122 on the upper edges of slot 112.

The flared portions 118 on rim 108 bow outwardly so that they hook or hold the cuff 14 of glove 12 as it is stretched over the rim 108. Teeth 120, 122 provided along the upper edges of slot 112 engage the cuff 14 in a manner which helps to vertically hold the cuff 14 of the glove in place.

It is common in the healthcare industry to use different types of gloves. For example, in surgery it is common to use elastic gloves which have a much longer cuff so that the cuff will extend up onto the forearm of the user and over the sleeves of the surgical gown. In contrast, examination gloves such as those used by dentists or by doctors in an examination room may have a much shorter cuff which terminates at the wrist. Accordingly, by providing a series of teeth as at 120, 122, the differing lengths of cuff for different types of gloves may be accommodated. This increases the versatility of the apparatus in accordance with other objects of the invention.

In accordance with the broad inventive concepts of the invention, the means for releasing the glove onto the hand after the hand is inserted into the glove is comprised, in the illustrated embodiments, of the slot 112 which is formed along the vertical length of cylindrical member 102. The release means may also be comprised of a sloping edge which is formed at the top of the cylindrical member 102, as schematically represented at arrow 114. As shown best in FIG. 2, the sloping edge schematically represented at 114 slopes downwardly toward the front of the apparatus and terminates at the point where the upper rim 108 meets the teeth 120, 122 formed on the upper edges of slot 112.

As hereinafter more fully described, the release means may also comprise the rounded edges which are formed along the entire periphery of upper rim 108 and also along the edges where teeth 120, 122 are formed on the upper edges of the slot 112. Teeth 120, 122 in particular are rounded and are tapered along the sides thereof to prevent catching and tearing of the cuff 14 of glove 12 as the cuff 14 is placed onto the apparatus, or upon removal of the glove during installation thereof onto the hand.

With the upper rim 108 sloping downwardly as schematically illustrated at 114 in FIG. 2, placement of the glove 12 onto the cylindrical member 102 is facilitated. When placing the glove onto the cylindrical member 102, the cuff 14 is first placed over the highest point of the upper rim 108 which is located toward the back of the cylindrical member 102. The sides of cuff 14 are then stretched outwardly as the cuff is pulled forward and down, forcing the cuff outward in the dimension X which is shown in FIG. 3 so that the cuff stretches over the flared portions 18. Finally, the cuff 14 is pulled slightly downward toward the front of the cylindrical member 102 so as to engage the appropriate position on teeth 120, 122 and is then released so that the elastic action of cuff 14 firmly engages the upper rim 108 and subrim portion 116 of the cylindrical member 102.

As previously mentioned, the means for holding the cuff of the glove in the stationary, open configuration ready for receiving the hand may comprise either singly or in combination the upper rim 108, flared portions 118 of upper rim 108 and teeth 120, 122. Other structures could also be readily devised for accomplishing this function. Frictional and mechanical engagement of the cuff 14 so as to hold it in the ready position in the manner desired could also be accomplished by, for example, the surface treatment provided on and the shape of the subrim area 116. The subrim area 116 could be provided with a convex shape so that it bulges out from the interior of cylindrical member 102, or a concave shape so that it bends inwardly toward the interior of cylindrical member 102, either of which would assist in providing the necessary frictional and mechanical engagement of cuff 14. Also, texturing the subrim area 116 could likewise provide frictional and mechanical engagement.

Figure 6:
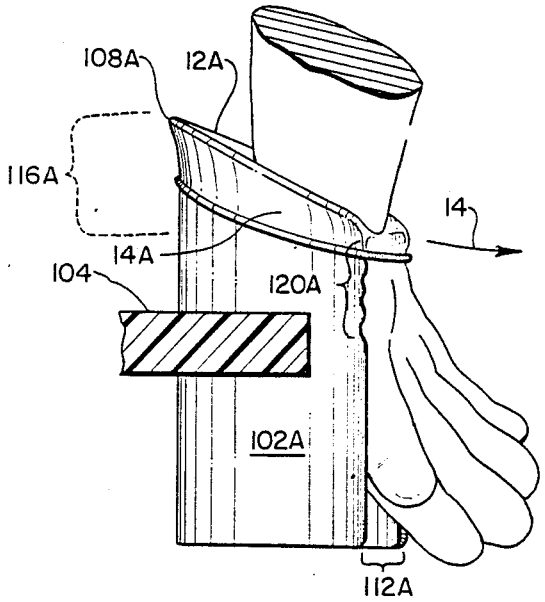
FIG. 6 is an elevated side view of the portion shown in FIG. 4 indicating the movement of the user's hand, wrist, and forearm in order to remove the glove from the apparatus.

The manner of removal of the glove 12 from the cylindrical member 102 once the hand has been inserted into the glove 12 is best understood from FIG. 6. Once the hand has been fully inserted into the glove 12, with the hand and wrist slightly bent the hand is moved forward through the slot 112 which is provided in the front of cylindrical member 102. As the hand is pushed slightly downward and is at the same time pulled forward, the front of the elastic cuff disengages teeth 120, 122 at the upper edges of slot 112. Thereafter, by continuing to pull the hand and wrist forward and then slightly upward the elastic cuff will be released from the flared portions 118 on the upper rim 108 and the elastic cuff will then typically quickly snap off the back portion of the upper rim 108 onto the wrist and, depending upon the length of the elastic cuff 14, onto the forearm of the user. Also note that the sloping edge of the upper rim 108 accomodates release of the elastic cuff when following the above-described procedure once the point is reached where the teeth 120, 122 are disengaged and the user begins to pull the hand and wrist slightly upward.

Following the above-described procedure and using the apparatus described herein, it is possible for an individual to easily and quickly don a pair of elastic gloves without requiring another individual's assistance and without touching the exterior of the glove.

Figure 7:
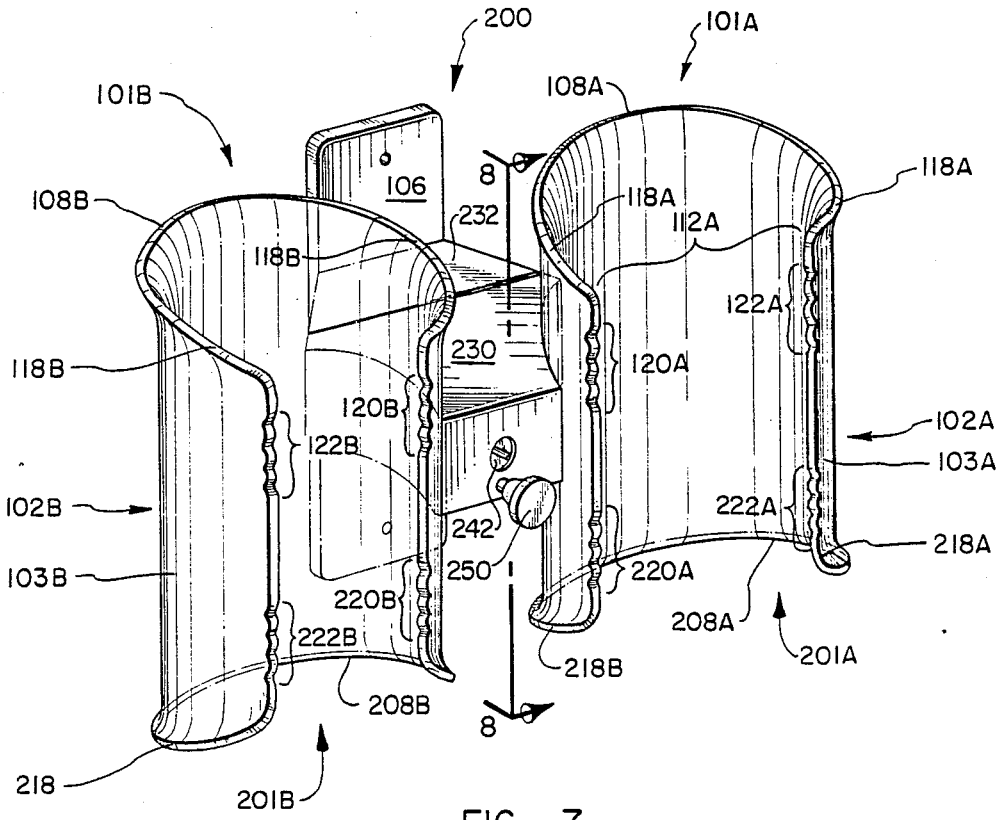
FIG. 7 is a perspective view of a second presently preferred embodiment of the present invention adapted to simultaneously hold two pairs of gloves, and adapted to rotate so that either pair of gloves may be alternately presented to the user.
Figure 8:
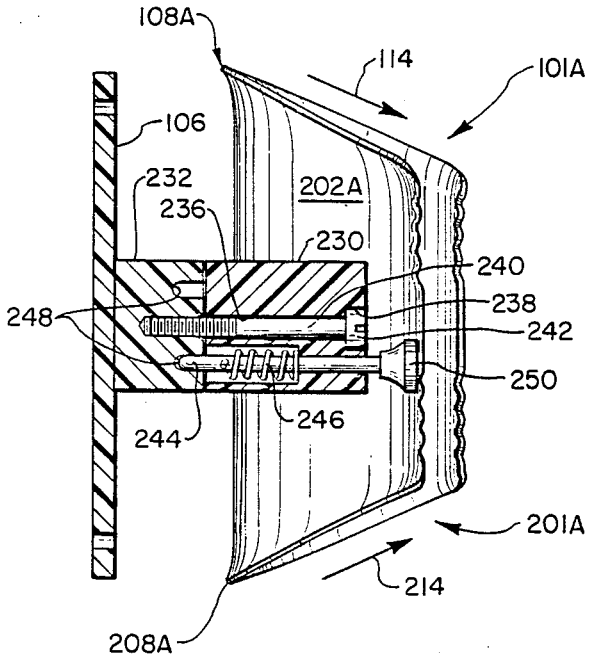
FIG. 8 is an elevated cross-sectional view of the second embodiment taken along line 8—8 of FIG. 7 and particularly illustrating in cross-section the working of the rotational mechanism.

A second embodiment of the glove applicator system is illustrated in the perspective view of FIG. 7 and the cross-sectional view of FIG. 8. The embodiment of FIG. 7 is identical in its structure and function to the embodiment of FIG. 1 described above except in two important aspects. In one aspect the embodiment of FIG. 7 differs from the first embodiment of the invention in that each of the cylindrical members 102 is configured on the opposite ends thereof with an identically configured means for receiving and holding the cuff of a glove in the open configuration ready for insertion of a hand. For example, in the apparatus 200 of FIG. 7, cylindrical member 102A comprises a glove applicator generally designated at 201A on the lower end thereof which is identical in configuration to glove applicator 101A on the upper end thereof. Accordingly, lower glove applicator 201A is provided with a rim 208A having flared portions 218A and teeth 220A, 222A on the lower edges of opening 112A.

The other important aspect wherein the apparatus 200 of FIG. 7 differs from the first embodiment is that the bracket which holds cylindrical members 102 comprises a swivel means for rotating the pair of cylindrical members 102 such that either of the opposite ends may be oriented toward the top. Thus, a first pair of gloves may be installed on one end of the apparatus while a second pair of gloves may installed on the other end. For example, a larger pair of gloves could be installed on the ends corresponding to the upper rims 108 while a second, different sized pair of gloves may be installed on the lower rims 208. Either pair of gloves may be readily installed by simply rotating the bracket, as hereinafter more fully described so as to orient the desired pair of gloves to be placed on the hands toward the top of the apparatus. As will be appreciated, this further enhances the versatility of the invention.

The presently preferred mechanism by which the means for providing rotation of the cylindrical members is comprised can be best understood from FIG. 8. A rear bracket member 232 is attached to plate 106. Secured to rear bracket member 232 is a front bracket member 230. The front bracket member 230 is attached to the cylindrical members 102 and spaces them from one another in the same manner as described in reference to bracket 104 of the first embodiment.

The front bracket member 230 is secured to the rear bracket member 232 by means of a bolt 242 which extends through cylindrical bore 236 of front bracket member 230 and threadingly engages rear bracket member 232. At least a portion of the shaft 240 of bolt 242 is smooth to permit rotation of the front bracket member 230 thereon.

A pin 244 is provided which normally, due to the biasing effect of spring 246, engages one of two bores 248 provided in rear holding bracket 234. Thus, by releasing pin 244 cylindrical members 102 may be secured in one of two positions, the positions being 180° apart from each other. When the user desires to rotate the apparatus, knob 250 located on the end of pin 244 may be grasped and pulled and the rotation effected.

Figure 9:
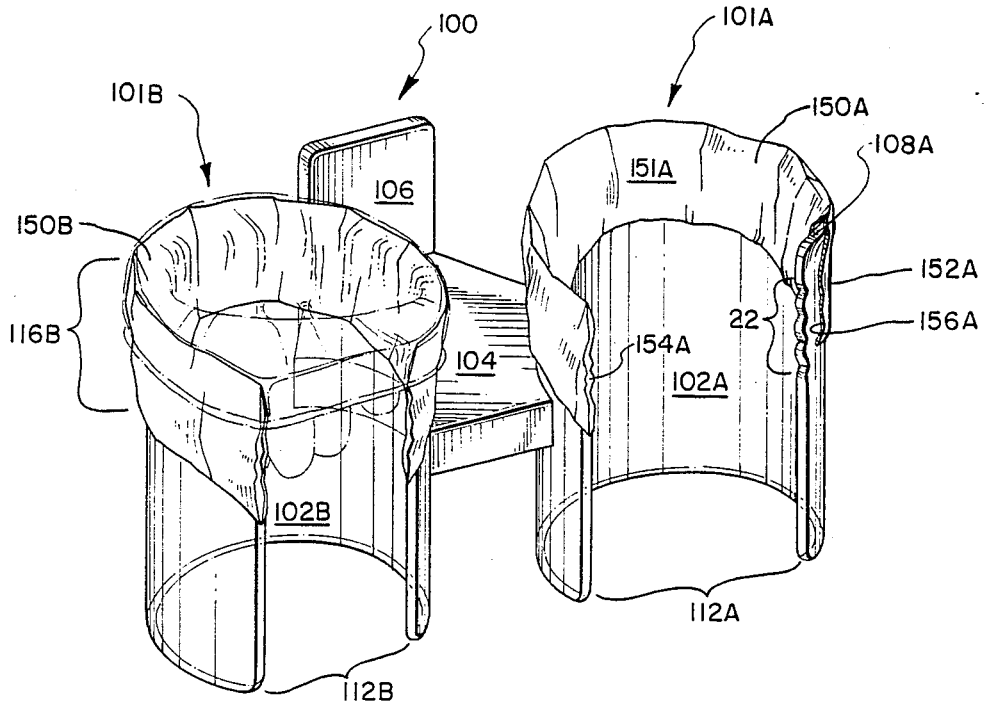
FIG. 9 is a perspective view of the first embodiment of the present invention wherein a disposable sterile shield has been placed over the upper rim of the apparatus.

As previously mentioned, in many health care situations it is essential that the sterility or cleanliness of the outer surface of the gloves is preserved. In FIG. 9 a pair of cylindrical members 102 identical to those illustrated in FIG. 1 have been provided with rim covers 150. Rim covers 150 may be fabricated using many materials and techniques well-known to those in the art. It is preferred that the rim covers 150 be fabricated so as to be disposable after a single use.

Each rim cover 150 provides a means for shielding the outer surface of a glove from contamination when the cuff of the glove comes into contact with the upper rim and subrim portions of the cylindrical members 102, thereby eliminating any need to sterilize apparatus 100. The rim covers 150 are each constructed so that the inner and outer sides thereof 151, 152 have a sufficient length to completely cover not only the upper rim 108 but also the subrim portion 116 and the teeth 120, 122 of the cylindrical member 102. The ends 154 of rim covers 150 are also closed so that complete enclosure of the entire upper portion of cylindrical members 102 is ensured. At the bottom of rim covers 150 there is a slot which accommodates placement of the rim covers 150 onto the upper portion of the cylindrical members 102. Optionally, the inner surface 156 of one or both of the inner or outer sides 151, 152 may be provided with an adhesive to facilitate temporarily holding the rim cover 150 in place when a glove is placed onto the cylindrical member and while a glove is being placed onto a hand and then removed. Once a glove has been removed from the rim cover 150 it may then be conveniently disposed of and replaced with a new sterile cover.

Figure 10:
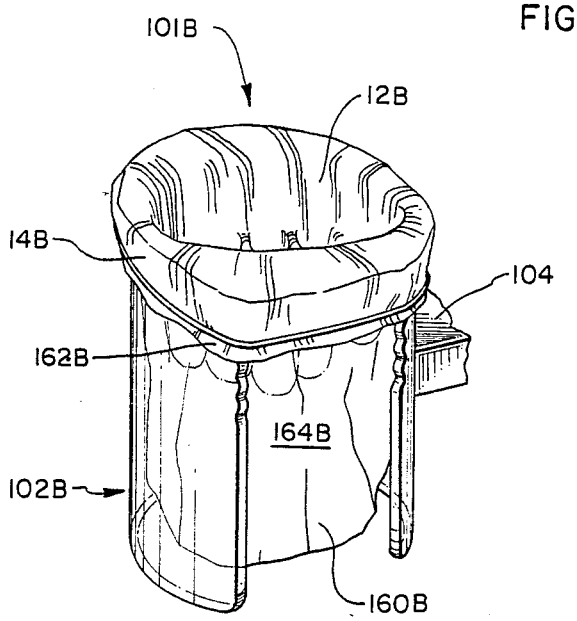
FIG. 10 is a perspective view of a portion of the first embodiment of the present invention whereon a sterile liner has been applied to the apparatus so as to shield the exterior surface of the glove from contamination.
Figure 11:
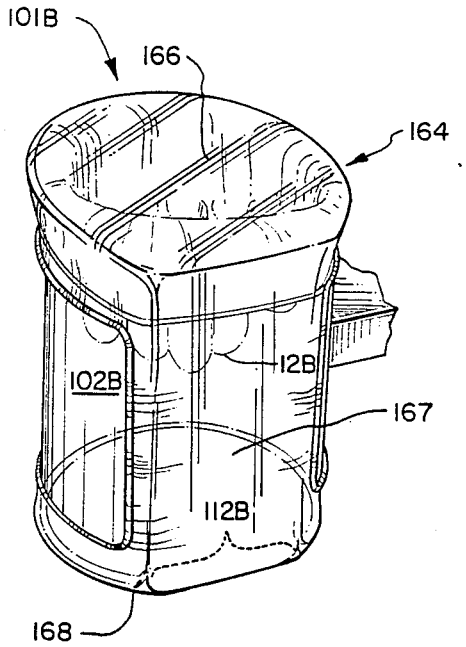
FIG. 11 is a perspective view of a portion of the first preferred embodiment of the present invention whereon a glove has been installed and a cover has been applied to the apparatus.
Figure 14:
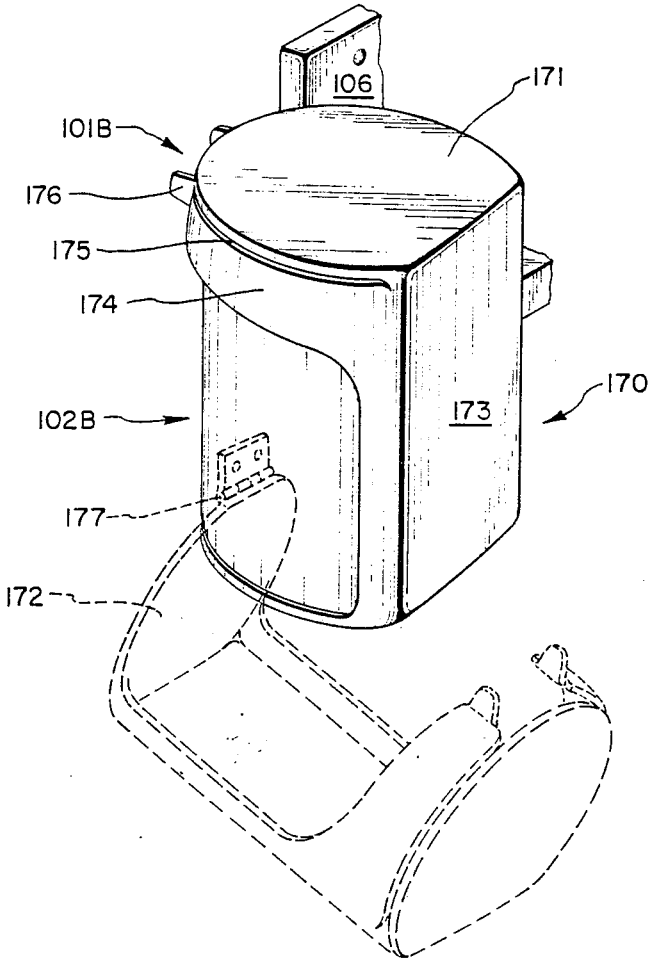
FIG. 14 is a perspective view of a portion of the first embodiment illustrating an additional mechanism adapted to shield the entire glove from contamination once the glove has been placed onto the apparatus.

Alternative means for shielding the outer surface of the gloves so as to maintain sterility or cleanliness thereof are illustrated in FIGS. 10, 11, and 14. Referring first to FIG. 10, there is illustrated in that figure a disposable liner 160. The liner 160 has an upper portion 162 which can be folded over the rim 108 of cylindrical member 102 and a lower sack portion 164 which extends downwardly inside of the cylindrical member 102, and into which the glove 12 extends when the cuff 14 is placed over the upper rim 108 and upper portion 162 of the liner. As will be appreciated from FIG. 10, the liner 160 completely surrounds the outer surface of glove 12 so as to shield it from contamination which would compromise sterility or cleanliness of the outer surface of the glove 12.

Other delivery systems which will conveniently allow sterility or cleanliness to be maintained would include, for example, temporarily bonding the interior surface of liner 160 to the exterior cuff 14 of a glove. In this way, protection of outer surface of the glove would be maintained until the glove is separated from the liner. Moreover, the glove and liner could then be simultaneously installed onto the apparatus.

In FIG. 11 a glove 12 is shown installed on the apparatus and a cover generally indicated at 164, is installed over the glove and portions of the apparatus. Cover 164 comprises top and bottom portions, 166 and 168, respectively, which cover the top and bottom openings in elongated cylindrical member 102. An interconnecting portion 167 covers slot 112. Cover 164 is preferably fabricated from an elastic material so that when installed an essentially air tight barrier is formed between the glove and the outside environment.

One further means for shielding the outer surface of the glove is illustrated in FIG. 14. As shown in that figure, a protective cover as generally designated at 170 comprises a top 171, a bottom 172 and an intermediate connecting portion 173 similar to the cover 164 described in FIG. 11. However, cover 170 is preferably formed of a plastic material. Cover 170 also comprises arms 174 which wrap around the upper portion of cylindrical member 102. Arms 174 are separated from the top 171 by a slit 175. This permits the arms 174 to bend outwardly as the arms 174 are spread apart when placing the cover 170 onto the cylindrical member 102.

At the leading end of arms 174 there are tabs 176 which can be used for purposes of spreading the arms 174. As further seen in FIG. 14, cover 170 is secured to the cylindrical member 102 by means of a hinge shown in phantom at 177. Thus, in use, after a glove is placed onto the apparatus the cover 170 may be swung up and the arms 174 spread open a sufficient distance to permit the cover 170 to engage the cylindrical member by means of arms 174. Since the cover is constructed of plastic, the arms 174 will have sufficient resiliency to firmly engage the cylindrical member 102 and hold the cover 170 in place. When it is desired to remove the cover 170 the arms 174 are spread apart by means of tabs 176 and the cover is then permitted to swing down and away from the cylindrical member 102 as illustrated by the phantom line position in FIG. 14. In that position, the gloves may then be installed onto the hands and removed from the apparatus in the manner described earlier.

Figure 12:
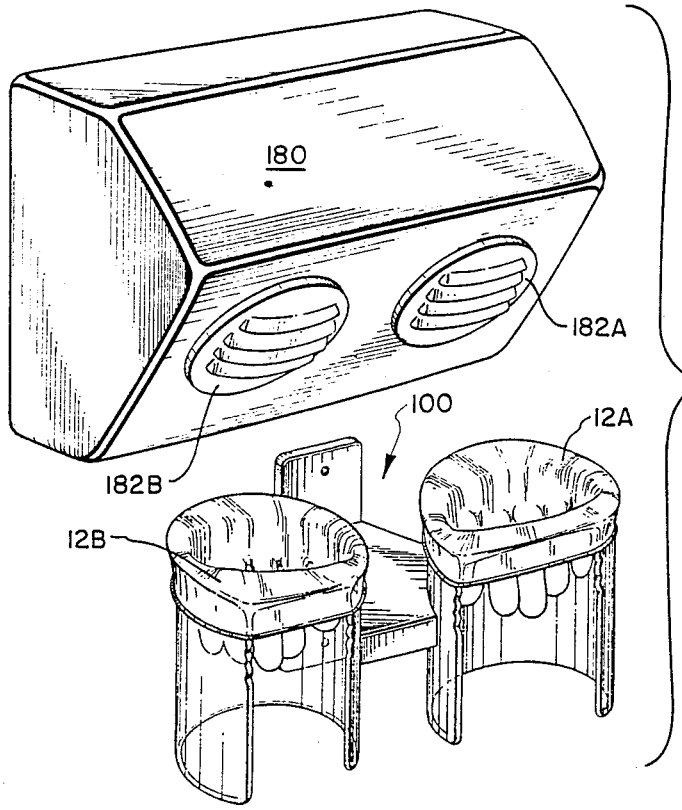
FIG. 12 is a perspective view of a presently preferred embodiment of the present invention which includes a blower mechanism.

Another feature of the present invention is represented in FIG. 12. The apparatus 100 is identical to that illustrated and described in connection with FIG. 1. However, a conventional hand blower 180 is mounted over the apparatus 100. Blower 180 is provided with vents 182A and 182B adapted for providing a forced air flow toward gloves 12. The air flow helps keep the finger and thumb openings 18 of the gloves open and ready to receive the user's hand. Furthermore, healthcare professionals commonly wash their hands just prior to donning a fresh pair of gloves. The operation of blower 180 will conveniently dry the user's hands so that problems with the hands sticking to the interior of the glove due to moisture will be reduced.

Figure 13:
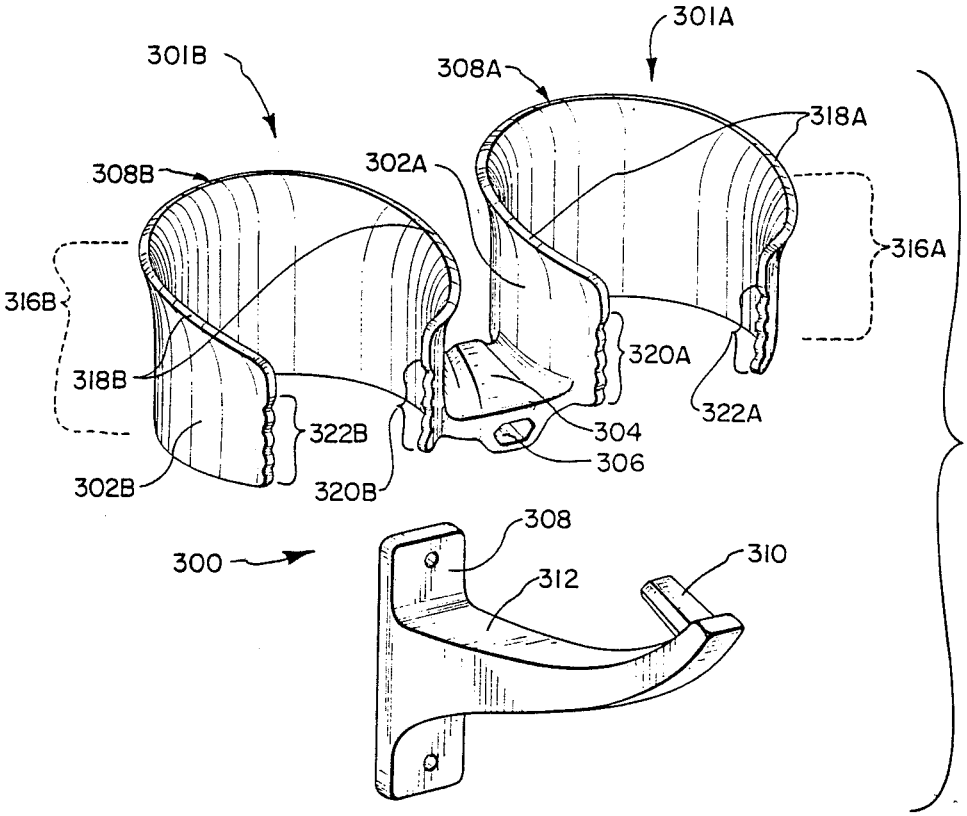
FIG. 13 is a perspective view of a third presently preferred embodiment of the present invention.

Illustrated in FIG. 13 is a third embodiment which is particularly adapted to be sterilized using conventional sterilization equipment. As shown in FIG. 13, the apparatus 300 comprises two glove applicators 301A and 302B each including a curved rim 308A and 308B and a subrim 316A and 316B, as well as flared portions 318A and 318B. However, the cylindrical members 302 are shortened.

In order to allow convenient removal of cylindrical members 302 for sterilization, an easily releasable holding structure is provided. In the embodiment illustrated in FIG. 13, a stem 312 is joined to a bracket 308 for mounting to an object such as a wall using appropriate fasteners. The end of stem 312 is provided with a triangular or hexagonal post 310.

Holding bracket 304, which interconnects cylindrical members 302, is provided with a corresponding recess 306 which receives post 310. Post 310 and recess 306 may preferably be provided with complementary tapers to assure a secure fit. The hexagonal post and recess arrangement allows the glove applicators to be firmly held in position during use yet easily removed for sterilization when desired. It should be noted that the end of stem 312 where post 310 is mounted curves up, to provide firm support as a user places his hands into the gloves and pulls down and forward to remove them.

Figure 15:
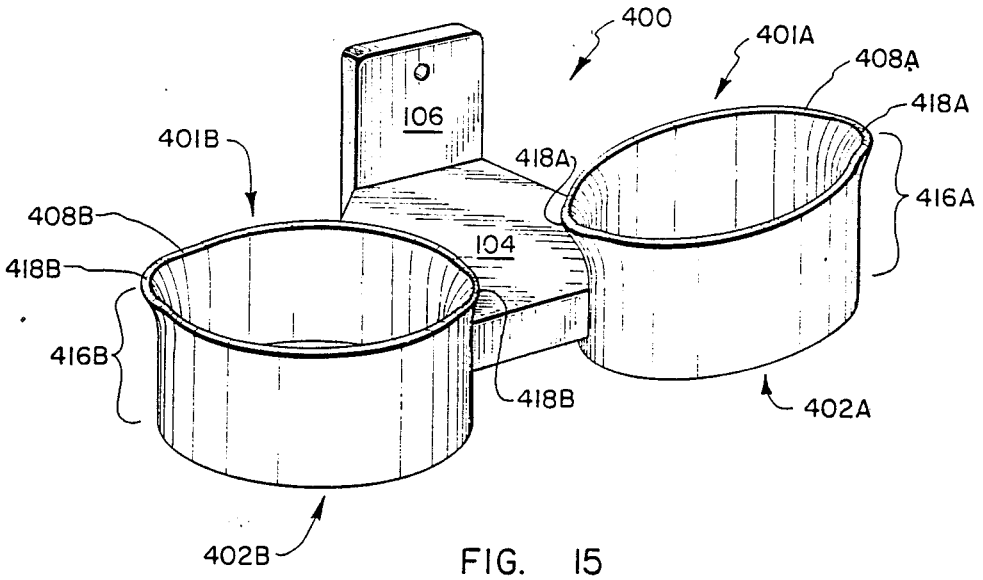
FIG. 15 is a perspective view of a fourth embodiment of the present invention.

One further embodiment of the apparatus of the present invention is illustrated in FIG. 15. In that figure the apparatus 400 is comprised of cylindrical members 402 which, similar to the cylindrical members of FIG. 13, are shortened rather than elongated. Cylindrical members 402 are each provided with an upper rim 408 and with flared portions 418 for receiving the elastic cuff 14 of gloves 12. However, cylindrical members 402 are continuous throughout the entire circumference thereof and are not provided with a slot as in the other embodiments described. Thus, when placing the gloves on the hands, the user inserts the hands into the gloves and then simply pushes the hands down and straight through the cylindrical members 402 until the elastic cuffs 14 of the gloves are pulled off of the rims 408.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for installing a glove having an elastic cuff onto a hand, the apparatus comprising:

a fixed bracket holding means, mountable to said fixed bracket so as to become integrally attached to said bracket as a part thereof when so mounted, for receiving the elastic cuff of the glove and for holding the cuff in a stretched, stationary, open configuration when the elastic cuff of said glove is stretched over said holding means, such that the glove is thereby held stretched and open and is ready to receive the hand inserted therein; and release means, formed on the holding means, for releasing the glove onto the hand after the hand is inserted therein and as the hand is moved downwardly and pulled forward so as to thereby pull the elastic cuff of said glove off of said holding means.

2. An apparatus as defined in claim 1 wherein said holding means comprises an essentially cylindrical member having an upper rim over which said cuff is stretched.

3. An apparatus as defined in claim 2 wherein said cylindrical member comprises vertically elongated sides so as to partially shield the outer surface of said glove when held by said cylindrical member.

4. An apparatus as defined in claim 2 wherein said holding means further comprises ear means, formed by a flared portion of said upper rim, over which said cuff is hooked.

5. An apparatus as defined in claim 2 wherein said cylindrical member is shaped in cross-section as a modified ellipse having a first dimension such that when said cuff is stretched over the upper rim, the cuff is stretched in a maximum manner along said first dimension, and said ellipse having a second dimension such that when stretched over the upper rim, the cuff is stretched in a minimal manner along said second dimension.

6. An apparatus as defined in claim 2 wherein said bracket means comprises means for attachment to a pair of said cylindrical members, and wherein said cylindrical members are a mirror image of one another and are spaced apart by said bracket means to accommodate insertion of the hands into gloves held on said members, by a simple downward movement.

7. An apparatus as defined in claim 6, wherein said means for attachment has a bore formed therein, and wherein said bracket means further comprises a post, and wherein said means for attachment and said cylindrical members may be removably held by said bracket means by fitting said post into said bore, and said post being configured to prevent rotation of the post when inserted into said bore.

8. An apparatus as defined in claim 6 wherein each said cylindrical member comprises a rim at opposite ends thereof, and wherein each said rim is configured to receive and hold an elastic cuff of a glove in said open configuration when the cuff is stretched over the rim.

9. An apparatus as defined in claim 8 wherein said bracket means comprises a swivel means for rotating said pair of cylindrical members such that the rims at either end of said cylindrical members may be rotated so as to be presented at the top of said apparatus, ready for installing a pair of said gloves.

10. An apparatus as defined in claim 9 wherein said bracket means comprises means for selectively locking and unlocking said bracket means whenever either of said opposite ends of said cylindrical members is oriented at the top of said apparatus.

11. An apparatus as defined in claim 6 further comprising blower means, mounted above said bracket means, for blowing air toward the inside surface of said gloves mounted on said cylindrical members.

12. An apparatus as defined in claim 2 further comprising a disposable, sterile liner means for covering said upper rim when a glove cuff is held thereon.

13. An apparatus as defined in claim 3 wherein said release means comprises a slot formed in the elongated sides of said cylindrical member to permit removal of the hand through said slot.

14. An apparatus as defined in claims 2 or 13 further comprising shield means for shielding the outer surface of said glove from contamination when said glove is held by said holding means.

15. An apparatus as defined in claim 14 wherein said shield means comprises a liner having an upper portion thereof fitting over said upper rim, and a sack portion which extends downwardly inside of said cylindrical member, and into which said glove extends when said cuff is placed over said upper rim and the upper portion of said liner.

16. An apparatus as defined in claim 14 wherein said shield means comprises cover means for fitting over at least said slot and an upper opening of said cylindrical member formed by said upper rim.

17. An apparatus as defined in claim 16 wherein said cover means comprises means for releasably attaching said cover means onto said cylindrical member.

18. An apparatus as defined in claim 17 wherein said cover means comprises hinge means for attaching said cover means to said cylindrical member, and snap means for releasably snapping said cover into place over said slot and said upper opening, whereby said cover is swung into place and secured by said snap means when a glove is held by said holding means, and whereby said cover is unsnapped and swings out of the way when installing said glove on a hand.

19. An apparatus as defined in claim 13 wherein said release means further comprises a downwardly sloping edge formed along said rim such that the lowermost points of said sloping edge terminate where said slot commences.

20. An apparatus as defined in claim 13 wherein said holding means further comprises teeth means, formed along upper edges of said slot, for securing said cuff of the glove between said teeth means.

21. An apparatus as defined in claim 20 wherein said teeth means and rim are rounded at the edges thereof to prevent catching and tearing said cuff as said glove is released, and wherein said release means is further comprised of said rounded edges.

22. An apparatus for installing a glove having an elastic cuff onto a hand, the apparatus comprising:

bracket means for mounting to a wall or other stationary object;

a cylindrical member comprising means for attachment to said bracket means so as to become an integral part thereof when so attached, said cylindrical member comprising an upper rim over which said elastic cuff of said glove is held in a stretched, stationary, open configuration such that the glove is ready to receive said hand inserted therein, and said cylindrical member further comprising sides extending downwardly from said upper rim and having a slot formed in said sides such that after the hand is inserted in the glove the hand may be moved downwardly and pulled forward through said slot to permit removal of the glove from said cylindrical member and installation of the glove onto the hand.

23. An apparatus as defined in claim 22 wherein said sides are vertically elongated so as to partially shield the outer surface of said glove when placed onto said cylindrical member.

24. An apparatus as defined in claim 22 wherein said upper rim slopes downwardly along the periphery thereof such that the lower most points of said upper rim terminate where said slot commences.

25. An apparatus as defined in claim 22 further comprising teeth means, formed along upper edges of said slot, for securing said elastic cuff of the glove between said teeth means.

26. An apparatus as defined in claim 25 wherein said teeth means and said upper rim are rounded at the edges thereof to prevent catching and tearing said elastic cuff as said glove is released therefrom.

27. An apparatus as defined in claim 22 further comprising a pair of flared portions formed on said upper rim and located essentially diametrally across from one another, said flared portions providing a means over which said elastic cuff is hooked as the cuff is placed onto said upper rim.

28. An apparatus as defined in claim 22 wherein the upper rim of said cylindrical member is shaped in cross-section as a modified ellipse having a first dimension such that when said cuff is stretched over the upper rim, the cuff is stretched in a maximum manner along said first dimension, and said ellipse having a second dimension such that when stretched over the upper rim, the cuff is stretched in a minimal manner along said second dimension.

29. An apparatus as defined in claim 22 further comprising shield means for shielding the outer surface of said glove from contamination when said glove is held by said cylindrical member.

30. An apparatus as defined in claim 29 wherein said shield means comprises a liner having an upper portion thereof fitting over said upper rim, and a sack portion which extends downwardly inside of said cylindrical member, and into which said glove extends when said cuff is placed over said upper rim and the upper portion of said liner.

31. An apparatus as defined in claim 29 wherein said shield means comprises cover means for fitting over at least said slot and an upper opening of said cylindrical member formed by said upper rim.

32. An apparatus as defined in claim 31 wherein said cover means comprises means for releasably attaching said cover means onto said cylindrical member.

33. An apparatus as defined in claim 32 wherein said cover means comprises hinge means for attaching said cover means to said cylindrical member, and snap means for releasably shaping said cover into place over said slot and said upper opening, whereby said cover is swung into place and secured by said snap means when a glove is held by said cylindrical member, and whereby said cover is unsnapped and swings out of the way when installing said glove on a hand.

34. An apparatus as defined in claim 22 wherein said bracket means comprises means for attachment to a pair of said cylindrical members, and wherein said cylindrical members are a mirror image of one another and are spaced apart by said bracket means to accommodate insertion of the hands into gloves held on said members, by a simple downward movement.

35. An apparatus as defined in claim 34 wherein said means for attachment has a bore formed therein, and wherein said bracket means further comprises a post, and wherein said means for attachment and said cylindrical members may be removably held by said bracket means by fitting said post into said bore, and said post being configured to prevent rotation of the post when inserted into said bore.

36. An apparatus as defined in claim 34 wherein each said cylindrical member comprises a rim at opposite ends thereof, and wherein each said rim is configured to receive and hold an elastic cuff of a glove in said open configuration when the cuff is stretched over the rim.

37. An apparatus as defined in claim 36 wherein said bracket means comprises a swivel means for rotating said pair of cylindrical members such that the rims at either end of said cylindrical members may be rotated so as to be presented at the top of said apparatus, ready for installing a pair of said gloves.

38. An apparatus as defined in claim 37 wherein said bracket means comprises means for selectively locking and unlocking said bracket means whenever either of said opposite ends of said cylindrical members is oriented at the top of said apparatus.

39. An apparatus as defined in claim 34 further comprising blower means, mounted above said bracket means, for blowing air toward the inside surface of said gloves mounted on said cylindrical members.

40. An apparatus as defined in claim 22 further comprising a disposable, sterile liner means for covering said upper rim when a glove cuff is held thereon.

41. An apparatus for installing a pair of gloves having elastic cuffs onto the hands of a user, the apparatus comprising:

bracket means for mounting to a wall or other stationary object; and a pair of cylindrical members mounted to said bracket means and spaced one from the other by said bracket means, each said cylindrical member comprising an upper rim and elongated sides which extend downwardly from said upper rim, said elongated sides having a slot formed therein with upper edges of said slot having teeth means formed thereon and said upper rim having a pair of flared portions formed thereon and being located essentially diametrally across from one another on said upper rim, said upper rim sloping downward such that the lower most point of said upper rim terminates at the point where said teeth means on the upper edges of said slot commerce, said upper rim, said flared portions and said teeth means together cooperating to receive and hold said elastic cuff in a stationary, open configuration when the elastic cuff is stretched over the upper rim, said flared portions, and said teeth means, said upper rim further comprising in cross-section a modified ellipsoidal shape having a first dimension such that when said elastic cuff is stretched over the upper rim, the cuff is stretched in a maximum manner along said first dimension, and having a second dimension such that when stretched over the upper rim, said elastic cuff is stretched in a minimal manner along said second dimension, and said slot providing an opening which is wide enough to permit removal of said hand after the hand is inserted into said glove and is moved downwardly and forward through said slot to effect release of said elastic cuff from said teeth means, said flared portions and said upper rim.

* * * * *

UNITED STATES PATENT AND TRADEMARK OFFICE

CERTIFICATE OF CORRECTION

PATENT NO. : 4,898,309

DATED : February 6, 1990

INVENTOR(S) : DAN E. FISCHER

It is certified that error appears in the above-identified patent and that said Letters Patent is hereby corrected as shown below:

Column 5, line 60, "heighth" should be --height--
Column 6, line 33, "of glove" should be --of the glove--
Column 11, line 42, "a fixed bracket" should be --a fixed bracket;--
Column 11, line 42, "holding means " should be a new subparagraph Signed and Sealed this Twenty-seventh Day of August, 1991

*Attest:*

HARRY F. MANBECK, JR.

*Attesting Officer*

*Commissioner of Patents and Trademarks*